US011708712B2

(12) United States Patent
Duer

(10) Patent No.: US 11,708,712 B2
(45) Date of Patent: Jul. 25, 2023

(54) FURNITURE HINGE

(71) Applicant: Julius Blum GmbH, Hoechst (AT)

(72) Inventor: Stefan Duer, Schwarzach (AT)

(73) Assignee: JULIUS BLUM GMBH, Hoechst (AT)

( * ) Notice: Subject to any disclaimer, the term of this patent is extended or adjusted under 35 U.S.C. 154(b) by 179 days.

(21) Appl. No.: 17/317,440

(22) Filed: May 11, 2021

(65) Prior Publication Data

US 2021/0262260 A1 Aug. 26, 2021

Related U.S. Application Data

(63) Continuation of application No. PCT/AT2019/060368, filed on Nov. 5, 2019.

(30) Foreign Application Priority Data

Nov. 13, 2018 (AT) ..... A 50978/2018

(51) Int. Cl.
*E05D 11/00* (2006.01)
*E05D 15/26* (2006.01)

(52) U.S. Cl.
CPC ..... *E05D 11/0054* (2013.01); *E05D 15/264* (2013.01); *E05D 2011/0072* (2013.01); *E05Y 2900/212* (2013.01)

(58) Field of Classification Search
CPC ... E05D 11/06; E05D 11/0054; E05D 15/264; E05D 2011/0063; E05D 2011/0072;
(Continued)

(56) References Cited

U.S. PATENT DOCUMENTS 2,586,757 A * 2/1952 Wummel ..... E05D 11/06 16/377
3,971,099 A * 7/1976 Wallace ..... E05D 11/06 16/50

(Continued)

FOREIGN PATENT DOCUMENTS

CN 1576504 2/2005
CN 108013623 5/2018

(Continued)

OTHER PUBLICATIONS

International Search Report dated Feb. 3, 2020 in International (PCT) Application No. PCT/AT2019/060368.

(Continued)

*Primary Examiner* — Chuck Y Mah
(74) *Attorney, Agent, or Firm* — Wenderoth, Lind & Ponack, L.L.P.

(57) ABSTRACT

A furniture hinge includes a first fitting portion, a second fitting portion, and a hinge axis hingedly connecting the first fitting portion and the second fitting portion. The fitting portions are movable between a first position, in which the furniture parts are aligned substantially coplanar to one another, and a second position, in which the furniture parts are aligned substantially parallel to one another. A cover can at least partially cover a gap formed between the first fitting portion and the second fitting portion, and a movement of the cover can be coupled to a movement of the furniture hinge. The first fitting portion and/or the second fitting portion includes an abutment, and the cover includes a counter-abutment. Upon a relative movement of the fitting portions, the abutment abuts against the counter-abutment. The cover, due to the abutment bearing against the counter-abutment, can be moved about the hinge axis.

21 Claims, 6 Drawing Sheets

(58) Field of Classification Search

CPC .. E05D 3/122; E05D 1/00; E05D 5/06; E05D 7/009; E05D 3/02; E05C 17/54; E05Y 2900/132; E05Y 2900/502; E05Y 2900/212; E05Y 2600/46; E05Y 2600/41; E05Y 2201/484; E05Y 2201/496; E05Y 2201/10; E05Y 2201/11; Y10T 16/533; Y10T 16/5335; Y10T 16/541; Y10T 16/542; Y10T 16/5388; E05F 1/1215; B64C 1/1461

See application file for complete search history.

(56) References Cited

U.S. PATENT DOCUMENTS

| | | | | |
|---|---|---|---|---|
| 4,679,277 | A * | 7/1987 | Shibata | E05D 3/122 16/382 |
| 5,448,799 | A * | 9/1995 | Stein, Jr. | E06B 3/486 16/225 |
| 5,991,975 | A | 11/1999 | Baer | |
| 6,170,210 | B1 * | 1/2001 | Marts | E05D 3/122 52/656.2 |
| 6,449,802 | B2 * | 9/2002 | Maeda | E06B 7/362 16/389 |
| 7,694,915 | B2 * | 4/2010 | Mindermann | E05D 11/0054 244/130 |
| 9,428,946 | B2 | 8/2016 | Martinez Garcia et al. | |
| 10,435,930 | B2 | 10/2019 | Abele | |
| 11,047,158 | B2 * | 6/2021 | Watanabe | E05F 1/1215 |
| 2003/0000656 | A1 | 1/2003 | Zen | |
| 2015/0233161 | A1 | 8/2015 | Martinez Garcia et al. | |
| 2015/0330127 | A1 * | 11/2015 | Lee | E05D 7/009 16/250 |
| 2018/0119466 | A1 | 5/2018 | Abele | |
| 2020/0002989 | A1 | 1/2020 | Bescherer-Nachtmann et al. | |

FOREIGN PATENT DOCUMENTS

| | | | | |
|---|---|---|---|---|
| EP | 2 899 344 | | 7/2015 | |
| EP | 3 590 650 | | 1/2020 | |
| ES | 1 060 412 | | 6/2005 | |
| GB | 2 456 144 | | 7/2009 | |
| JP | 52-145948 | | 4/1951 | |
| JP | 56-112390 | | 1/1955 | |
| JP | 08013933 | A * | 1/1996 | |
| JP | 2009180053 | A * | 8/2009 | |
| JP | 2009-275468 | | 11/2009 | |
| JP | 2009293304 | A * | 12/2009 | |
| JP | 2010-84403 | | 4/2010 | |
| JP | 2010189879 | A * | 9/2010 | E06B 7/367 |
| JP | 2011-111786 | | 6/2011 | |
| KR | 10-2016-0087107 | | 7/2016 | |
| WO | 99/23337 | | 5/1999 | |
| WO | 2013/015542 | | 1/2013 | |

OTHER PUBLICATIONS

Search Report dated Mar. 15, 2022 in corresponding Chinese Patent Application No. 201980074742.x.

* cited by examiner

FURNITURE HINGE

BACKGROUND OF THE INVENTION

The present invention relates to a furniture hinge including a first fitting portion configured to be fixed to a first furniture part, a second fitting portion configured to be fixed to a second furniture part, and at least one hinge axis by which the first fitting portion and the second fitting portion are hingedly connected to one another. The fitting portions are movable relative to one another between a first position, in which the furniture parts connected to the fitting portions in a mounted condition are aligned substantially coplanar to one another, and a second position, in which the furniture parts connected to the fitting portions in the mounted condition are aligned substantially parallel to one another. A cover is movably supported about the hinge axis, the cover is configured to at least partially cover a gap formed between the first fitting portion and the second fitting portion, and a movement of the cover can be coupled to a movement of the furniture hinge.

Moreover, the invention concerns an item of furniture comprising at least two furniture parts movable relative to a furniture carcass and at least one furniture hinge of the type to be described for moving the furniture parts.

Furniture hinges with a cover configured to be moved relative to the fitting portions upon a movement of the furniture hinge are already known from EP 2 899 344 A1 and WO 99/23337 A1. The cover is configured to cover a gap formed between the furniture parts, so that an engagement of fingers into the gap can be prevented, the ingress of dirt into the interior of the item of furniture can be reduced and a visually attractive appearance can be afforded. A movement of the cover is thereby always coupled to a movement of the hinge. Because of the fact that the size of the gap formed between the furniture parts varies upon the relative position of the furniture parts to one another, certain motion sequences of the furniture hinge cannot be realized due to the presence of a permanently-coupled cover. The kinematics of the furniture hinge is namely then obstructed when the cover abuts against the furniture parts or against a hinge mechanism of the furniture hinge in a relative position of the furniture hinge and, therefore, a further movement of the furniture hinge is blocked.

GB 2 456 144 A discloses a furniture hinge having a finger guard, and the finger guard includes a cover configured to pivot about a hinge axis. The cover is moved about the hinge axis by abutment surfaces of the fitting portions, so that a hinge gap which is formed between the fitting portions can be covered and an engagement of fingers in that gap can be prevented. A drawback is the fact that the construction is only suitable for applications in which the maximum opening angle of the door is limited to approximately 110°.

SUMMARY OF THE INVENTION

It is an object of the present invention to propose a furniture hinge of the type mentioned in the introductory part, thereby avoiding the drawbacks as discussed above.

According to the invention, the first fitting portion and/or the second fitting portion includes or include at least one abutment and that the cover includes at least one counter-abutment. The abutment of the first fitting portion and/or of the second fitting portion, upon a relative movement of the fitting portions to one another, abuts against the counter-abutment of the cover, and the cover, due to the at least one abutment bearing against the at least one counter-abutment, is configured to be moved at least partially about the hinge axis.

In other words, the cover is freely pivotable on the furniture hinge, or possibly configured to be moved about the hinge axis against a force of a force storage member. The cover is only moved about the hinge axis over a predetermined pivotal path by the co-operation of an abutment arranged on the fitting portions with a counter-abutment arranged on the cover. The fitting portions of the furniture hinge are pivotally supported to one another over a predetermined angle range. The cover is not moved over a first partial path of the angle range, and is only moved over a second partial path immediately adjoining the first partial path of the angle range, due to the co-operation of the abutment with the counter-abutment, into a predetermined end position of the fitting portions or into a predetermined end position of the furniture parts connected to the fitting portions in a mounted condition.

In this way, the cover can be automatically centered upon each closing movement and/or opening movement, so that the cover is optimally aligned in the respective end positions of the furniture parts connected to the fitting portions.

Basically, the presence of one single abutment of the fitting portions and the presence of one single counter-abutment of the cover can be sufficient for moving the cover into a first pivoting direction. For a movement of the cover in a second pivoting direction opposing the first pivoting direction, the cover may have a second counter-abutment configured to abut against a second abutment of the first fitting portion and/or the second fitting portion upon a relative movement of the fitting portions to one another. Therefore, the cover is configured to be moved at least partially about the hinge axis due to the second abutment bearing against the second counter-abutment.

However, the arrangement of a second abutment of the fitting portions and/or the arrangement of a second counter-abutment on the cover is not mandatorily required. With an alternative embodiment, it can namely be provided that the cover can be moved in a first pivoting direction due to the at least one abutment of the fitting portions bearing against the at least one counter-abutment of the cover, against a force of a force storage member (for example a spiral spring), so that the force storage member can be loaded. The cover can then be driven in a second pivoting direction, opposing the first pivoting direction, by a force of the force storage member.

The cover can have a longitudinal extension, and it is preferably provided that a shell surface of the cover, in a cross-section perpendicular to the longitudinal extension, is configured to be curved-shaped. According to an embodiment, the shell surface of the cover can be configured so as to be partially cylindrical. It is preferable that the shell surface of the cover extends over more than a semi-cylinder.

The furniture hinge can include at least one hinge body pivotally supported about the hinge axis, and the cover is connected to the hinge body or is configured to be releasably connected to the hinge body. It can be preferably provided that the cover is configured to be snapped onto the at least one hinge body. The hinge body can thereby be configured to be freely pivotable about the hinge axis, or may be movably arranged about the hinge axis against a force of a force storage member.

The hinge body can be pivotally and coaxially arranged to the at least one hinge axis. It can be preferably provided that the at least one hinge body is configured substantially cylindrical. The hinge body can have a ribbing at least over a region, and the ribbing is provided for releasably fixing the cover.

According to an embodiment, it can be provided that at least two hinge bodies are provided, the at least two hinge bodies being spaced from each other along the hinge axis.

According to a further embodiment, the counter-abutment of the cover can extend substantially parallel to a longitudinal axis of the cover. It can be preferably provided that the counter-abutment extends substantially over an entire length of the cover. The counter-abutment of the cover can be configured, for example, as a rounded limb extending at least over a region in the longitudinal direction of the cover.

According to the invention, the fitting portions of the furniture hinge are movable relative to one another between a first position, in which the furniture parts connected to the fitting portions in a mounted condition are aligned substantially coplanar to one another, and a second position, in which the furniture parts connected to the fitting portions in the mounted condition are aligned substantially parallel to one another.

BRIEF DESCRIPTION OF THE DRAWINGS

Further details and advantages of the invention result from the following description of figures, in which.

DETAILED DESCRIPTION OF THE INVENTION

Figure 1A:
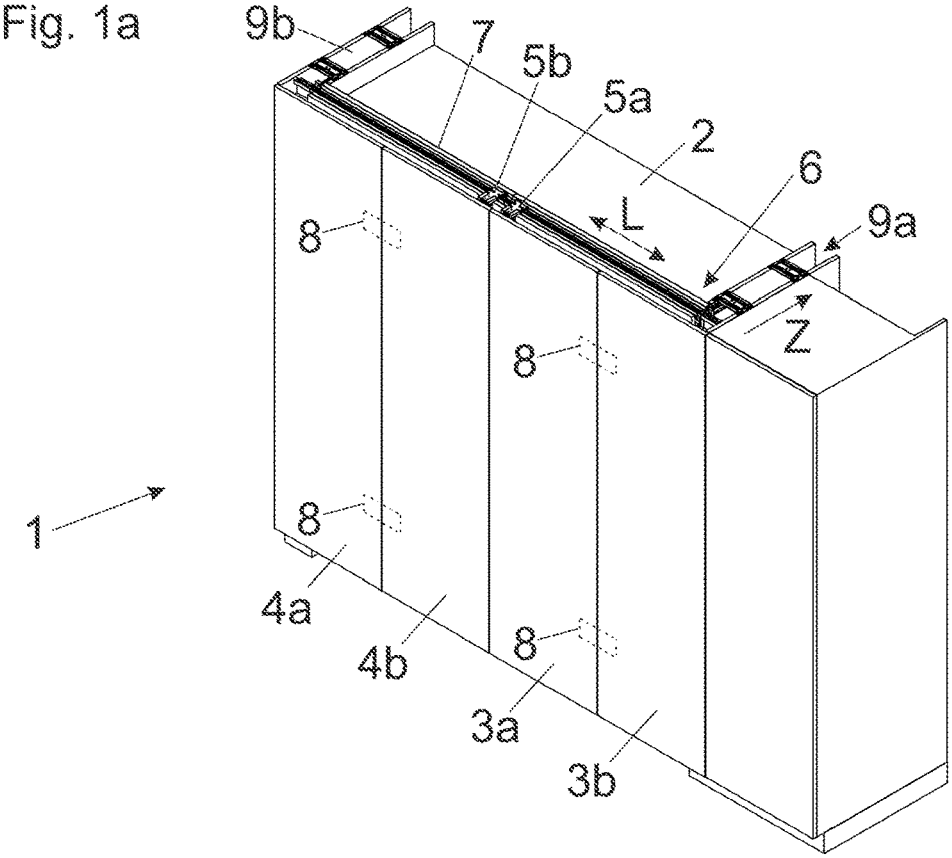
FIG. 1*a*, 1*b* are perspective views of an item of furniture comprising a furniture carcass and furniture parts movably-supported relative to the furniture carcass in two different positions.

FIG. 1*a* shows an item of furniture 1 comprising a furniture carcass 2 and furniture parts 3*a*, 3*b* and 4*a*, 4*b*, each of the furniture parts 3*a*, 3*b* and 4*a*, 4*b* being movably supported relative to the furniture carcass 2. The furniture parts 3*a*, 3*b* are hingedly connected to one another by two or more furniture hinges 8, the furniture hinges 8 being spaced from each other in a height direction and being fixed to a rear side of the furniture parts 3*a*, 3*b*. The other two furniture parts 4*a*, 4*b* are also pivotally connected to one another by two or more furniture hinges 8 spaced from one another in the height direction. In the shown figure, the furniture parts 3*a*, 3*b* and 4*a*, 4*b* are located in a first position in which the furniture parts 3*a*, 3*b* and 4*a*, 4*b* are aligned substantially coplanar to one another. The furniture parts 3*a*, 3*b* and 4*a*, 4*b* are movable relative to the furniture carcass 2 by a guide system 6, the guide system 6 including a guide rail 7 and running carriages 5*a*, 5*b* movably supported in a longitudinal direction (L) of the guide rail 7. The guide rail 7, in a mounted condition, is arranged substantially parallel to a front edge of the furniture carcass 2. The first running carriage 5*a* is hingedly connected to the furniture part 3*a*, whereas the second running carriage 5*b* is pivotally connected to the furniture part 4*b*.

Figure 1B:
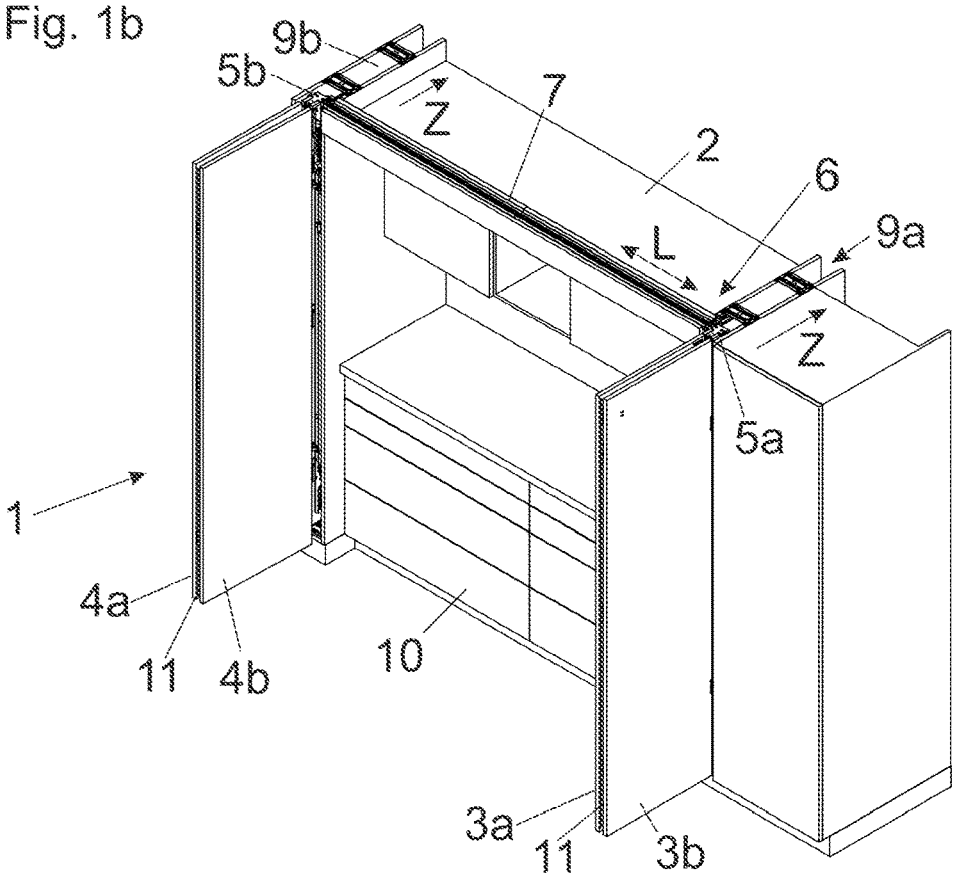

FIG. 1*b* shows the item of furniture 1 according to FIG. 1*a*, in which the furniture parts 3*a*, 3*b* and 4*a*, 4*b* are located in a second position in which the furniture parts 3*a*, 3*b* and 4*a*, 4*b* are aligned substantially parallel to one another. The furniture parts 3*a*, 3*b*, in a parallel position to one another, can be inserted—jointly with the first running carriage 5*a*—into a first lateral insertion compartment 9*a* in a depth direction (Z). The other furniture parts 4*a*, 4*b*, in a parallel position to one another, can be inserted—together with the second running carriage 5*b*—into a second lateral insertion compartment 9*b* in the depth direction (Z). A gap is formed between each of the furniture parts 3*a*, 3*b* and 4*a*, 4*b*, and the gap can be at least partially covered by a cover 11 in at least one relative position of the furniture hinges 8. In the parallel positions of the furniture parts 3*a*, 3*b* and 4*a*, 4*b*, the covers 11 are arranged between the furniture parts 3*a*, 3*b* and 4*a*, 4*b*. The covers 11 are formed as longitudinal profiles made of metal or plastic, the covers 11 extending substantially over an entire height of the furniture parts 3*a*, 3*b* and 4*a*, 4*b*. A direct comparison between FIG. 1*a* and FIG. 1*b* shows that in a first position, in which the furniture parts 3*a*, 3*b* and 4*a*, 4*b* are aligned substantially coplanar to one another (FIG. 1*a*), an inner carcass 10 can be entirely separated from the remaining area of a room. In the second position, in which the furniture parts 3*a*, 3*b* and 4*a*, 4*b* are aligned substantially parallel to one another, the inner carcass 10 is freely accessible for a person. For example, the inner carcass 10 can be in the form of a kitchen block, an office niche, a storage room, a shelf or a walk-in closet.

Figure 2:
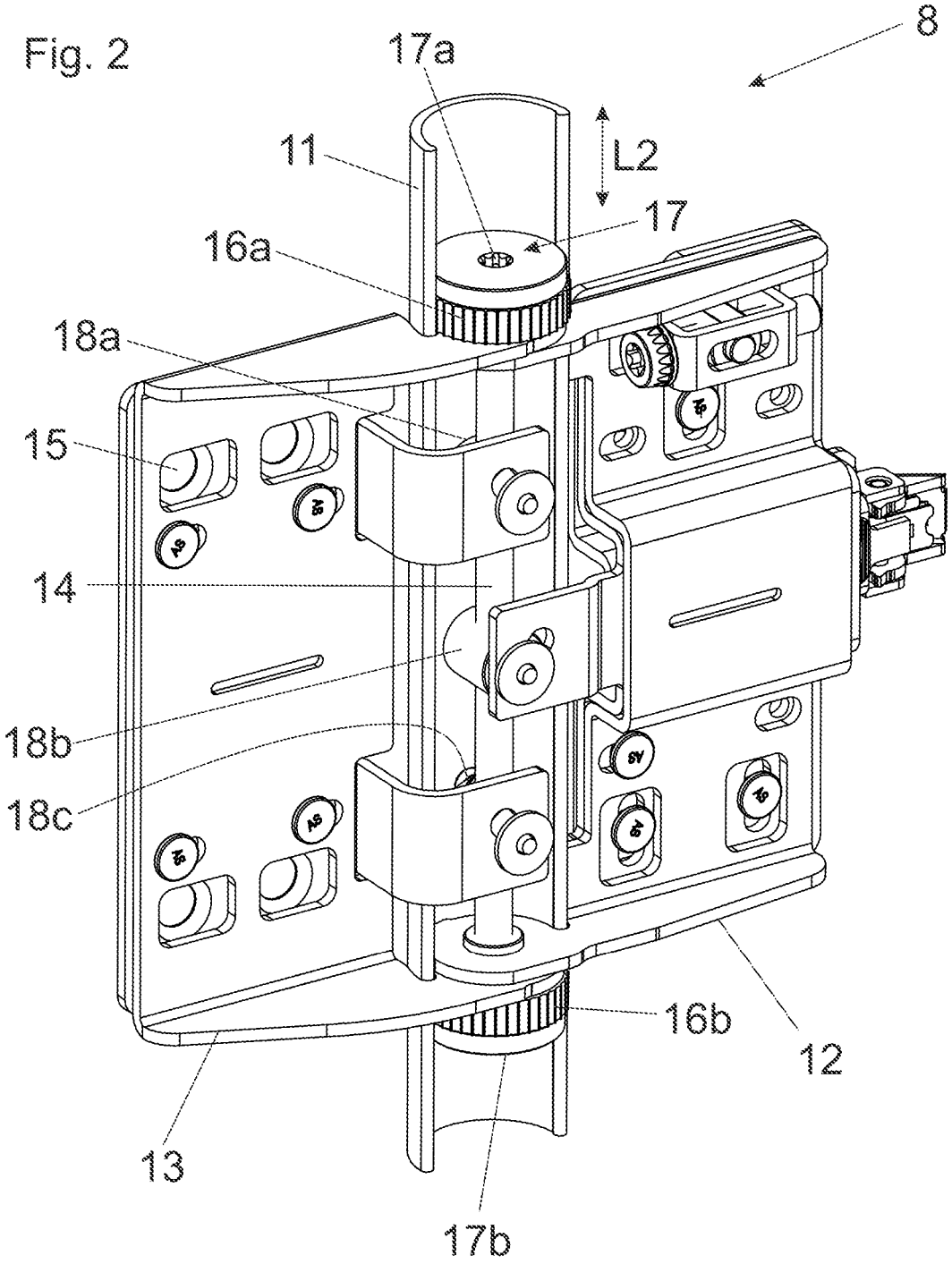
FIG. 2 shows a possible embodiment of a furniture hinge in a perspective view.

FIG. 2 shows a possible embodiment of a furniture hinge 8 in a perspective view. The furniture hinge 8 includes a first fitting portion 12 configured to be fixed to a first furniture part 3*a* and a second fitting portion 13 configured to be fixed to a second furniture part 3*b*. The first fitting portion 12 and the second fitting portion 13 are pivotally connected to one another by at least one hinge axis 14. Each of the fitting portions 12, 13 can include a flat-shaped bearing surface configured to be fixed to a flat-shaped inner side of the furniture parts 3*a*, 3*b*. The first fitting portion 12 and/or the second fitting portion 13 can include at least one or a plurality of fastening locations 15, for example in the form of bores. By the fastening locations 15, the fitting portions 12, 13 can be fixed to the furniture parts 3*a*, 3*b*, for example with the aid of screws. In FIG. 2, the fitting portions 12, 13 are located in a position corresponding to the coplanar first position of the furniture parts 3*a*, 3*b* to one another (FIG. 1*a*).

The cover 11 has a longitudinal direction (L2), and a shell surface of the cover 11, in a cross-section perpendicular to the longitudinal direction (L2), can be curved-shaped. According to a possible embodiment, the shell surface of the cover 11 can be partially cylindrical. Preferably, the shell surface of the cover 11 extends over more than a semi-cylinder. The cover 11 is connected or is configured to be releasably connected to the furniture hinge 8. In the shown embodiment, the cover 11 is configured to be releasably connected to at least one hinge body 16*a*. Preferably, the cover 11 is configured to be releasably connected to the hinge body 16*a* by a snap-connection device. The hinge body 16*a* is freely pivotally supported about the hinge axis 14, or is possibly movable about the hinge axis 14 against an action of a force storage member. The at least one hinge body 16*a* can be arranged coaxially to the hinge axis 14. Preferably, the at least one hinge body 16*a* is substantially cylindrical. In the shown embodiment, two identically configured hinge bodies 16*a*, 16*b* are provided, the hinge bodies 16*a*, 16*b* being spaced from one another along the hinge axis 14.

The furniture hinge 8 includes at least one adjustment device 17 having at least one movably supported adjustment element 17*a*. By an actuation of the at least one adjustment element 17*a*, a position of the first fitting portion 12 relative to the second fitting portion 13 can be adjusted. With a possible embodiment, by an actuation of the at least one adjustment element 17*a*, the position of the first fitting portion 12 and the position of the second fitting portion 13 can be synchronically and symmetrically adjusted in relation to the at least one hinge axis 14, preferably in a direction perpendicular to the hinge axis 14. For example, this can be implemented such that the hinge axis 14 is configured as a threaded spindle at least over a region, and the threaded spindle is in threading engagement with two or more threaded nuts 18*a*, 18*b*, 18*c*. The threaded nut 18*b* is connected to the first fitting portion 12, whereas the other threaded nuts 18*a*, 18*c* are connected to the second fitting portion 13. Upon a rotation of the adjustment element 17*a*, the threaded nuts 18*a*, 18*b*, 18*c* are adjustable along the hinge axis 14. Therefore, the fitting portions 12, 13 can be synchronically and symmetrically adjusted in relation to the hinge axis 14. The adjustment element 17*a* can have a receiving device for a tool, so that the adjustment element 17*a* can be rotated with the aid of a tool. Upon a rotation of the adjustment element 17*a*, the hinge bodies 16*a*, 16*b* cannot be rotated, because the hinge bodies 16*a*, 16*b* are loosely supported about the hinge axis 14. In the shown figure, two adjustment elements 17*a*, 17*b* are provided, and the two adjustment elements 17*a*, 17*b* are spaced from one another along the hinge axis 14. In this way, the adjustment elements 17*a*, 17*b* can be actuated from above and from below, preferably with the aid of a tool in the form of a screwdriver, in order for a position of the fitting portions 12, 13 to be adjusted relative to one another.

Figure 3:
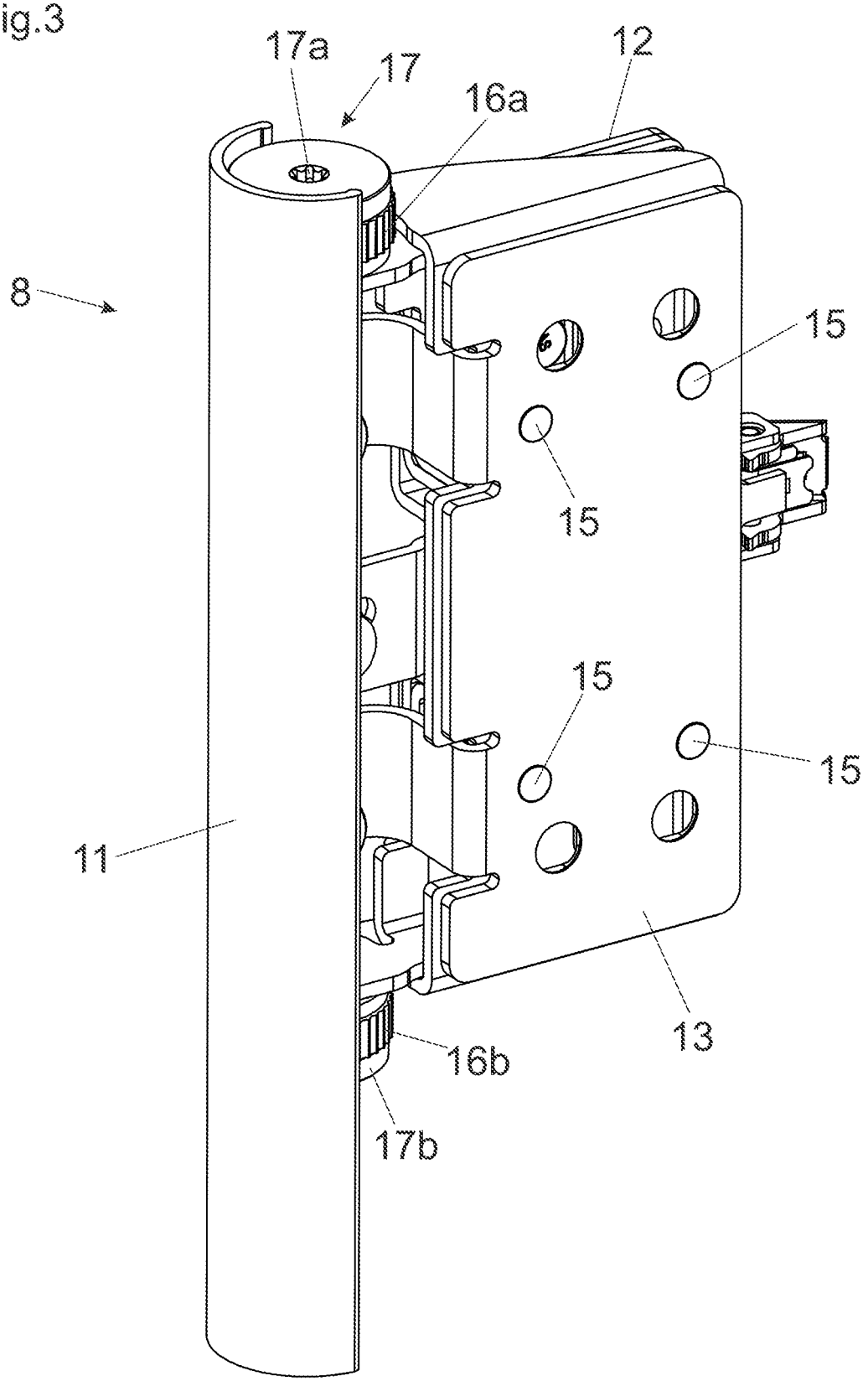
FIG. 3 shows the furniture hinge according to FIG. 2 in a further relative position of the fitting portions to one another.

FIG. 3 shows the furniture hinge 8 in a perspective view, in which the fitting portions 12, 13 are located in a position corresponding to the parallel second position of the furniture parts 3*a*, 3*b* to one another (FIG. 1*b*). The cover 11 is thereby located in a centered position in relation to the fitting portions 12, 13, so that the cover 11 at least partially covers a gap formed between the furniture parts 3*a*, 3*b* when the furniture parts 3*a*, 3*b* are aligned parallel to one another. Thereby, the cover 11, in the parallel position of the furniture parts 3*a*, 3*b* to one another, is arranged between the furniture parts 3*a*, 3*b*, whereby an unobtrusive and compact arrangement of the cover 11 can be afforded.

Figure 4:
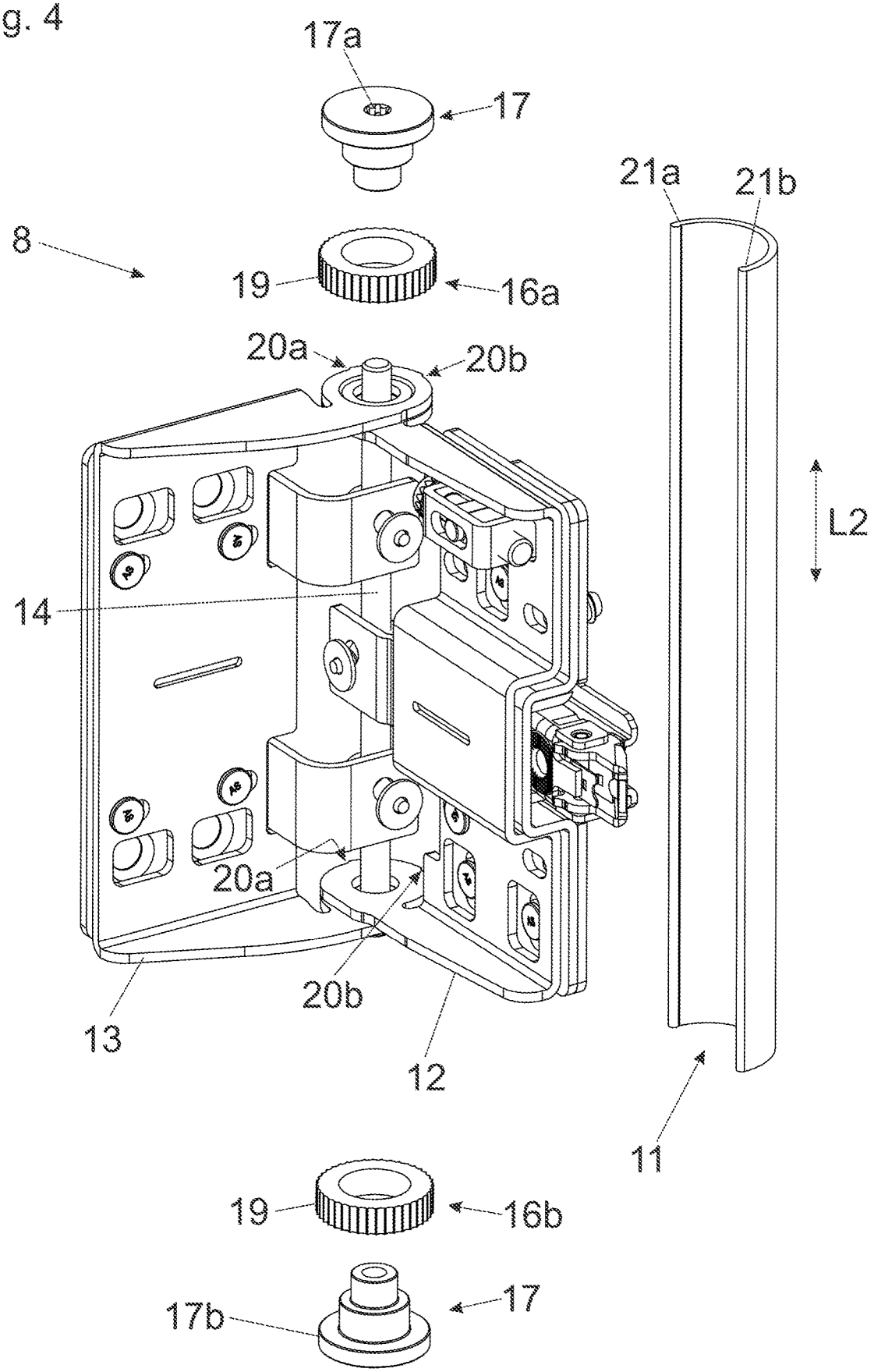
FIG. 4 shows the furniture hinge in an exploded view.

FIG. 4 shows the furniture hinge 8 in an exploded view. The first fitting portion 12 and the second fitting portion 13 are pivotally connected to one another by at least one hinge axis 14. The hinge axis 14 can be rotated by the adjustment elements 17*a*, 17*b* of the adjustment device 17 for adjusting a relative position between the first fitting portion 12 and the second fitting portion 13. A peripheral surface of the substantially cylindrical hinge bodies 16*a*, 16*b* can be provided with a ribbing 19 for releasably fixing the cover 11 to the annular-shaped hinge bodies 16*a*, 16*b*. At least one abutment 20*a*, 20*b*, preferably in the form of a control edge integrally formed on one of the fitting portions 12, 13, is arranged on the first fitting portion 12 and/or on the second fitting portion 13. At least one counter-abutment 21*a*, 21*b* is arranged or formed on the cover 11, the at least one counter-abutment 21*a*, 21*b* extending substantially parallel to a longitudinal direction (L2) of the cover 11. Preferably, the counter-abutment 21*a*, 21*b* extends over substantially an entire length of the cover 11. In the shown figure, the counter-abutment 21*a*, 21*b* of the cover 11 is configured as a rounded limb extending at least over a region along the longitudinal direction (L2) of the cover 11. Upon a movement of the fitting portions 12, 13, starting from the position shown in FIG. 4 into a position according to FIG. 3, in which the furniture parts 3*a*, 3*b* connected to the fitting portions 12, 13 in the mounted condition are aligned substantially parallel to one another, the abutment 20*a* of the fitting portions 12, 13 abuts against the counter-abutment 21*a* of the cover 11. Therefore, the cover 11 can be entrained in a pivoting direction about the hinge axis 14 due to the co-operation of the abutment 20*a* with the counter-abutment 21*a*, so that the cover 11 eventually reaches the pivoting position shown in FIG. 3.

In the shown embodiment, the cover 11 includes a second counter-abutment 21*b* configured to be identical as the first counter-abutment 21*a*. A second abutment 20*b* can be arranged on the first fitting portion 12 and/or on the second fitting portion 13, the second abutment 20*b* being configured to co-operate with the second counter-abutment 21*b* of the cover 11. Upon a movement of the fitting portions 12, 13, starting from the position shown in FIG. 3 in which the furniture parts 3*a*, 3*b* connected to the fitting portions 12, 13 in the mounted condition are aligned substantially parallel to one another, into the position shown in FIG. 2, in which the furniture parts 3*a*, 3*b* are aligned substantially coplanar to one another, the second abutment 20*b* of the fitting portions 12, 13 abuts against the second counter-abutment 21*b* of the cover 11. Therefore, the cover 11 can be entrained in a second pivoting direction about the hinge axis 14 due to the co-operation of the second abutment 20*b* with the second counter-abutment 21*b*, so that the cover 11 eventually reaches the pivoting position shown in FIG. 2.

As already mentioned in the introductory part, the arrangement of a second abutment 20*b* of the fitting portions 12, 13 and the arrangement of a second counter-abutment 21*b* of the cover 11 is not mandatorily required, because the cover 11 can be moved in a first pivoting direction, due to the co-operation of the first abutment 20*a* with the first counter-abutment 21*a*, against a force of a force storage member. Therefore, the cover 11 can be driven at least partially about the hinge axis 14 in a second pivoting direction by a force of the force storage member. However, the arrangement of two counter-abutments 21*a*, 21*b* on the cover 11 offers the opportunity to snap the cover 11 onto the ribbings 19 of the hinge bodies 16*a*, 16*b* via the two counter-abutments 21*a*, 21*b*. In a fixed condition, the cover 11 is held with a sufficient holding force on the hinge bodies 16*a*, 16*b* by a material elasticity of the cover 11.

Due to the co-operation of the first abutment 20*a* of the fitting portions 12, 13 with the first counter-abutment 21*a* of the cover 11, and due to the co-operation of the second abutment 20*b* of the fitting portions 12, 13 with the second counter-abutment 21*b* of the cover 11, the cover 11 can be newly centered upon each opening and closing movement. According to an embodiment, the at least one abutment 20*a*, 20*b*, jointly with one of the fitting portions 12, 13, has an integral one-piece configuration, and/or that the at least one counter-abutment 21*a*, 21*b*, jointly with the cover 11, has an integral one-piece configuration.

Figure 5A:
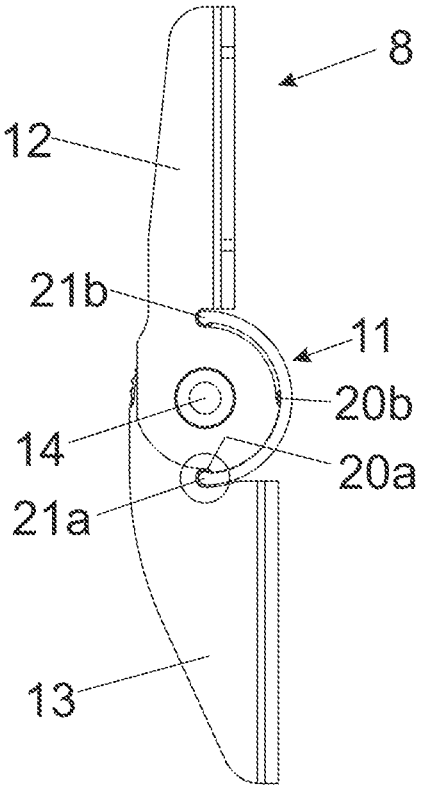
FIG. 5*a*-5*d* show the furniture hinge in two different relative positions of the fitting portions to one another in a view from below, and enlarged detail views thereof.
Figure 5B:
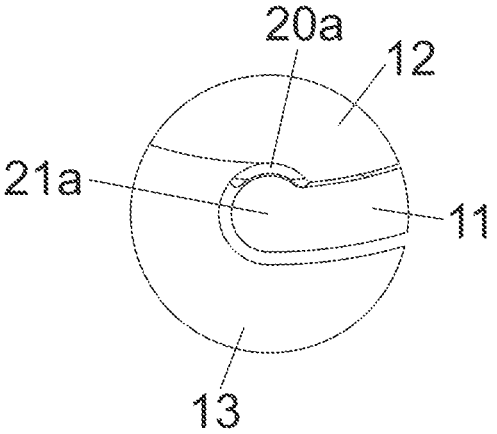

FIG. 5*a* shows the furniture hinge 8 in a view from below, in which the furniture parts 3*a*, 3*b* connected to the fitting portions 12, 13 in a mounted condition are aligned substantially coplanar to one another. Visible is the cover 11 with the two counter-abutments 21*a*, 21*b*. In the shown figure, the abutment 20*a* of the fitting portions 12, 13 bears against the counter-abutment 21*a* of the cover 11. FIG. 5*b* shows the encircled region of FIG. 5*a* in an enlarged view.

Figure 5C:
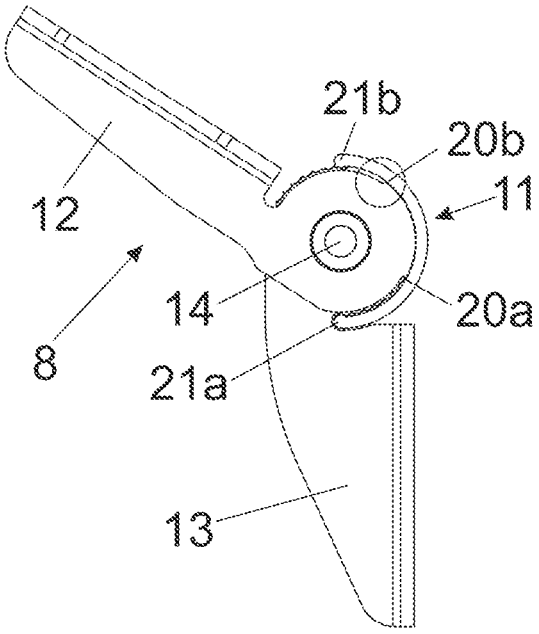
Figure 5D:
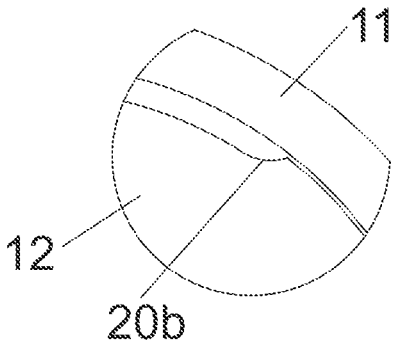

When now the fitting portions 12, 13 are moved relative to one another, the abutment 20*a* of the fitting portions 12, 13 is lifted from the counter-abutment 21*a* of the cover 11 (FIG. 5*c*), and the cover 11 remains in its relative position, that is to say that the cover 11 is not yet rotated about the hinge axis 14. In this intermediate position of the fitting portions 12, 13, the abutments 20*a*, 20*b* of the fitting portions 12, 13 are spaced from the counter-abutments 21*a*, 21*b* of the cover 11. FIG. 5*d* shows the encircled region of FIG. 5*c* in an enlarged view. It can be seen that the abutments 20*a*, 20*b* can be arranged offset relative to one another by approximately 90° on at least one of the fitting portions 12, 13.

Figure 6A:
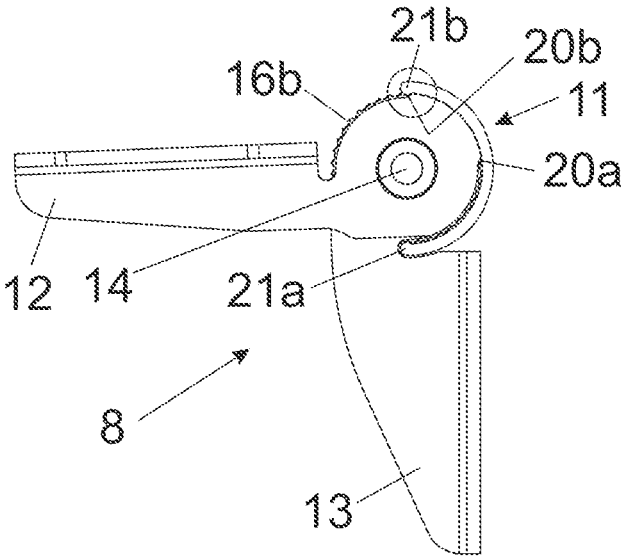
FIG. 6*a*-6*d* show the furniture hinge in two further relative positions of the fitting portions to one another in a view from below, and enlarged detail views thereof.
Figure 6B:
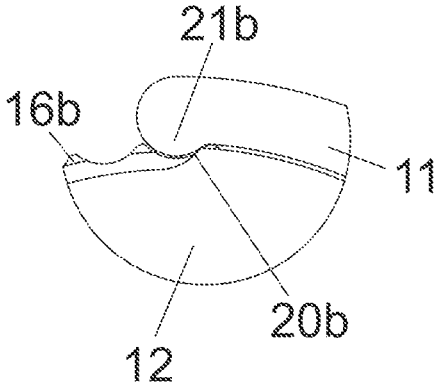

FIG. 6*a* shows the furniture hinge 8 in a view from below in a further relative position of the fitting portions 12, 13 to one another, in which the furniture parts 3*a*, 3*b* connected to the fitting portions 12, 13 in a mounted condition adopt an angle of approximately 90° to one another. It can be seen that the abutment 20*b* of the fitting portions 12, 13 abuts against the counter-abutment 21*b* of the cover 11, thereby initiating the start of a pivoting movement of the cover 11 about the hinge axis 14. FIG. 6*b* shows the encircled region of FIG. 6*a* in an enlarged view.

Figure 6C:
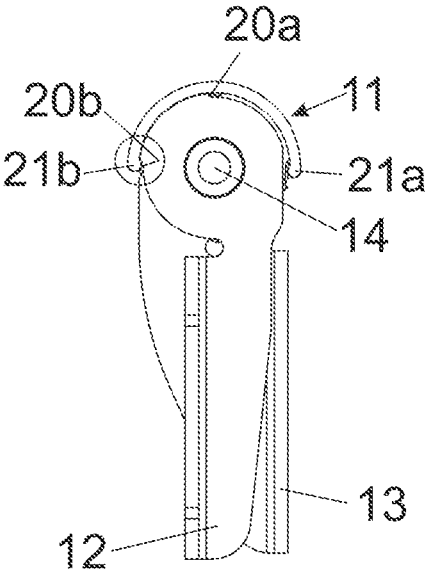
Figure 6D:
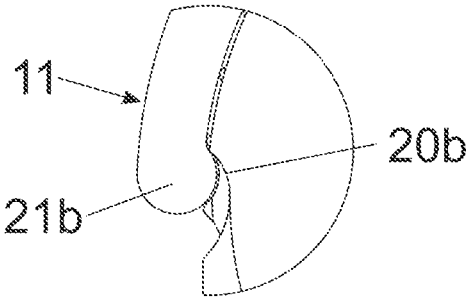

By a continued movement of the fitting portions 12, 13 to one another, the cover 11 is pivoted in a counterclockwise direction due to the co-operation of the abutment 20*b* with the counter-abutment 21*b*. In FIG. 6*c*, the fitting portions 12, 13 have reached a position in which the furniture parts 3*a*, 3*b* connected to the fitting portions 12, 13 in a mounted condition are aligned substantially parallel to one another (FIG. 1*b*). The cover 11 has been moved by the abutment 20*b* of the fitting portions 12, 13, starting from FIG. 6*a*, over a partial path of the maximum pivoting angle range of the furniture hinge 8 about the hinge axis 14, and the cover 11 is centered relative to the fitting portions 12, 13.

The invention claimed is:

1. A furniture hinge, comprising:

a first fitting portion configured to be fixed to a first furniture part;

a second fitting portion configured to be fixed to a second furniture part;

a hinge axis hingedly connecting the first fitting portion and the second fitting portion to one another, the first fitting portion and the second fitting portion being movable relative to one another between a first position, in which the first furniture part and the second furniture part are aligned substantially coplanar to one another, and a second position, in which the first furniture part and the second furniture part are aligned substantially parallel to one another; and a cover movably supported about the hinge axis, the cover being configured to at least partially cover a gap formed between the first fitting portion and the second fitting portion, and a movement of the cover is coupled to a movement of the furniture hinge, wherein at least one of the first fitting portion and the second fitting portion includes an abutment and the cover includes a counter-abutment, wherein the abutment of the at least one of the first fitting portion and the second fitting portion, upon a relative movement of the first fitting portion and the second fitting portion relative to each other, abuts against the counter-abutment of the cover, and the cover is configured to be moved at least partially about the hinge axis due to the abutment bearing against the counter-abutment.

2. The furniture hinge according to claim 1, wherein the cover has a longitudinal direction, and a shell surface of the cover, in a cross-section perpendicular to the longitudinal direction, is curved-shaped.

3. The furniture hinge according to claim 1, wherein a shell surface of the cover is partially cylindrical.

4. The furniture hinge according to claim 3, wherein the shell surface of the cover extends over more than a semi-cylinder.

5. The furniture hinge according to claim 1, wherein the furniture hinge includes a hinge body pivotally supported about the hinge axis, wherein the cover is connected or is configured to be releasably connected to the hinge body.

6. The furniture hinge according to claim 5, wherein the hinge body is coaxially arranged with respect to the hinge axis.

7. The furniture hinge according to claim 6, wherein the hinge body is substantially cylindrical.

8. The furniture hinge according to claim 5, wherein the hinge body has a ribbing for releasably fixing the cover thereto.

9. The furniture hinge according to claim 5, wherein the hinge body is a first hinge body of at least two hinge bodies, the at least two hinge bodies being spaced from one another along the hinge axis.

10. The furniture hinge according to claim 1, wherein the counter-abutment of the cover extends substantially parallel to a longitudinal direction of the cover.

11. The furniture hinge according to claim 10, wherein the counter-abutment extends substantially over an entire length of the cover.

12. The furniture hinge according to claim 1, wherein the counter-abutment of the cover is configured as a rounded limb.

13. The furniture hinge according to claim 1, wherein the counter-abutment of the cover, in the first position or in the second position, bears against the abutment of the at least one of the first fitting portion and the second fitting portion.

14. The furniture hinge according to claim 1, wherein the counter-abutment of the cover, in at least one intermediate position located between the first position and the second position of the furniture hinge, is spaced from the abutment of the at least one of the first fitting portion and the second fitting portion.

15. The furniture hinge according to claim 1, wherein the abutment has an integral one-piece configuration jointly with the at least one of the first fitting portion and the second fitting portion, and/or the counter-abutment has an integral one-piece configuration jointly with the cover.

16. The furniture hinge according to claim 1, wherein the cover is movable about the hinge axis in a first pivoting direction due to the co-operation of the abutment with the counter-abutment.

17. The furniture hinge according to claim 16, wherein at least one of the first fitting portion and the second fitting portion further includes a second abutment and the cover includes a second counter-abutment, the cover being movable about the hinge axis in a second pivoting direction opposing the first pivoting direction due to the co-operation of the second abutment with the second counter-abutment.

18. An item of furniture comprising a furniture carcass, a first furniture part, and a second furniture part, each of the first furniture part and the second furniture part being movably supported relative to the furniture carcass and being hingedly connected to one another by the furniture hinge according to claim 1.

19. The furniture hinge according to claim 1, further comprising an adjustment device having a movably supported adjustment element configured to adjust a position of the first fitting portion relative to the second fitting portion via actuation of the adjustment element.

20. The furniture hinge according to claim 19, wherein the adjustment device is configured such that, by an actuation of the adjustment element, a position of the first fitting portion and a position of the second fitting portion are synchronically and symmetrically adjusted in relation to the hinge axis.

21. The furniture hinge according to claim 20, wherein the actuation of the adjustment element adjusts the position of the first fitting portion and the position of the second fitting portion in a direction perpendicular to the hinge axis.

* * * * *